US009047844B2

(12) United States Patent
Ito

(10) Patent No.: US 9,047,844 B2
(45) Date of Patent: Jun. 2, 2015

(54) APPARATUS AND METHOD FOR DRIVING AN ELECTRO-OPTICAL DEVICE AND AN ELECTRONIC APPARATUS USING A DATA LINE DRIVING CIRCUIT FOR SUPPLYING A CORRECTED VOLTAGE

(75) Inventor: Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 558 days.

(21) Appl. No.: 12/612,783

(22) Filed: Nov. 5, 2009

(65) Prior Publication Data

US 2010/0128011 A1 May 27, 2010

(30) Foreign Application Priority Data

Nov. 25, 2008 (JP) ..... 2008-299152

(51) Int. Cl.
*G09G 3/36* (2006.01)

(52) U.S. Cl.
CPC ..... *G09G 3/3688* (2013.01); *G09G 3/3614* (2013.01); *G09G 2310/0218* (2013.01); *G09G 2310/0248* (2013.01); *G09G 2310/0297* (2013.01); *G09G 2320/0219* (2013.01); *G09G 2320/0233* (2013.01)

(58) Field of Classification Search
CPC ..... G09G 3/3614
USPC ..... 345/87–103
See application file for complete search history.

(56) References Cited

U.S. PATENT DOCUMENTS

| | | | | |
|---|---|---|---|---|
| 5,708,454 | A * | 1/1998 | Katoh et al. | 345/100 |
| 7,352,314 | B2 | 4/2008 | Horibata | |
| 2002/0126112 | A1 * | 9/2002 | Kato | 345/204 |
| 2005/0041488 | A1 * | 2/2005 | Ito et al. | 365/199 |
| 2005/0156820 | A1 | 7/2005 | Aoki | |
| 2006/0007723 | A1 | 1/2006 | Aoki et al. | |
| 2006/0087484 | A1 | 4/2006 | Kumeta et al. | |
| 2006/0087488 | A1 | 4/2006 | Ito | |
| 2006/0227090 | A1 * | 10/2006 | Ishii | 345/98 |
| 2006/0232539 | A1 | 10/2006 | Hashimoto | |
| 2006/0290611 | A1 * | 12/2006 | Tsuge | 345/74.1 |
| 2008/0055197 | A1 | 3/2008 | Iisaka et al. | |

FOREIGN PATENT DOCUMENTS

| | | | |
|---|---|---|---|
| JP | 2004-045967 | 2/2004 | |
| JP | 2004045967 A * | 2/2004 | G09G 3/36 |

(Continued)

*Primary Examiner* — Srilakshmi K Kumar
*Assistant Examiner* — Charles Zheng
(74) *Attorney, Agent, or Firm* — Maschoff Brennan

(57) ABSTRACT

An apparatus for driving an electro-optical device is disclosed. The apparatus includes a plurality of scanning lines, a plurality of data lines that intersect the plurality of scanning lines, and are divided so that the neighboring data lines form another group of data lines, a plurality of pixels provided to correspond to the intersection of the plurality of scanning lines and the plurality of data lines, a data line driving circuit that supplies a correction voltage being simultaneously supplied to the group of data lines and having a fixed polarity with respect to a predetermined potential, and a driving voltage being time-serially supplied to the group of data lines in response to an image signal and having a polarity that is inverted for each frame with respect to the predetermined potential, and a scanning line driving circuit that supplies a scanning signal through the plurality of scanning lines.

12 Claims, 9 Drawing Sheets

(56) References Cited

FOREIGN PATENT DOCUMENTS

| | | | |
|---|---|---|---|
| JP | 2005-043418 | | 2/2005 |
| JP | 2006-330510 | A | 12/2006 |
| JP | 2007-053459 | A | 3/2007 |
| JP | 2008-268395 | A | 11/2008 |
| TW | 200606793 | A | 2/2006 |

* cited by examiner

FIG. 5

| | $(L-1)^{th}$ FRAME | $L^{th}$ FRAME | $(L+1)^{th}$ FRAME |
|---|---|---|---|
| $(L-1)^{th}$ HORIZONTAL PERIOD | $1^{st}$ PATTERN | $2^{nd}$ PATTERN | $3^{rd}$ PATTERN |
| $L^{th}$ HORIZONTAL PERIOD | $2^{nd}$ PATTERN | $3^{rd}$ PATTERN | $1^{st}$ PATTERN |
| $(L+1)^{th}$ HORIZONTAL PERIOD | $3^{rd}$ PATTERN | $1^{st}$ PATTERN | $2^{nd}$ PATTERN |

* $1^{st}$ PATTERN 1: REPEAT IN ORDER OF S1, S2 AND S3
  $2^{nd}$ PATTERN 2: REPEAT IN ORDER OF S2, S3 AND S1
  $3^{rd}$ PATTERN 3: REPEAT IN ORDER OF S3, S1 AND S2

FIG. 9

| EVALUATION | FIRST CORRECTION VOLTAGE V1 | SECOND CORRECTION VOLTAGE V2 | EVALUATION |
|---|---|---|---|
| a | −4 V | +5 V | 1 |
| b | −4 V | +2.5 V | 1 |
| c | −4 V | 0 V | 2 |
| d | −4 V | −1 V | 3 |
| e | −4 V | −3.5 V | 4 |
| f | −4 V | −4.5 V | 4 |

* EVALUATION

1: LARGE CROSSTALK
2: MIDDLE CROSSTALK
3: SMALL CROSSTALK (EFFECTIVELY NO TROUBLE IN LEVEL)
4: MINIMUM CROSSTALK (ALMOST INVISIBLE LEVEL)
5: NO CROSSTALK

APPARATUS AND METHOD FOR DRIVING AN ELECTRO-OPTICAL DEVICE AND AN ELECTRONIC APPARATUS USING A DATA LINE DRIVING CIRCUIT FOR SUPPLYING A CORRECTED VOLTAGE

The entire disclosure of Japanese Patent Application No. 2008-299152, filed Nov. 25, 2008 is expressly incorporated herein by reference.

BACKGROUND OF THE INVENTION

1. Technical Field

The present invention relates to an apparatus and method for driving an electro-optical device. More particularly, the present invention relates to an electro-optical device, such as a liquid crystal device, which includes a driving apparatus, such as, for example, a liquid crystal projector, and a method for driving an electro-optical device.

2. Related Art

An electro-optical device controls the orientation of an electro-optical substance interposed between a pair of electrodes, such as liquid crystal substance, by applying a driving voltage corresponding to an image signal between the pair of electrodes, causing an image to be displayed. The driving voltage is applied with the polarity of the driving voltage being reversed, so as to prevent burn-in or flicker from being created in the displayed image. In particular, parasitic capacitance occurs between data lines of an image signal which are used to prescribe gradation of pixels and pixel rows connected to the data lines. This parasitic capacitance causes display unevenness to occur in the displayed image in a direction along the data line.

Japanese Patent Application JP-A-2004-45967 discloses a technique for reducing the display unevenness and improving an image quality of a displayed image by changing the order that the image signal is supplied to the data line. Another Japanese Patent Application, JP-A-2005-43418, discloses a technique for increasing the speed of writing data into the pixels and thus suppressing the display unevenness by overlapping the correction voltage, wherein the polarity is reversed according to the polarity of the driving voltage so as to overlap the correction voltage with the driving voltage corresponding to the image signal. The overlapped correction voltage is then applied.

One difficulty with these techniques, however, is that although the display unevenness can be improved to some extent, a lot of display unevenness remains, meaning that further improvement of the image quality is required. For example, in an electro-optical device equipped in an apparatus, such as a liquid crystal projector, a thin film transistor is used to switch the timing control of the driving voltage sent to, for example, a pixel electrode. Because the pixel electrode is exposed to strong light, current leakage can occur. In other words, there is a problem that the occurrence of light current leakage causes a reduction in the potential of the pixel electrode and increases the unevenness of the displayed image.

BRIEF SUMMARY OF THE INVENTION

An advantage of some aspects of the invention is to provide an apparatus and method for driving an electro-optical device which can prevent burn-in of a displayed image and reduce flicker. The electro-optical device can also display an image at a high quality. The electro-optical device described herein includes a driving apparatus and an electronic apparatus including the electro-optical device.

According to an aspect of the invention, there is provided an apparatus for driving an electro-optical device, including: a plurality of scanning lines; a plurality of data lines that intersect the plurality of scanning lines, and that are divided so that the adjacent data lines form another group of data lines; a plurality of pixels provided to correspond to intersection of the plurality of scanning lines and the plurality of data lines; a data line driving circuit that simultaneously supplies a correction voltage having a fixed polarity with respect to a predetermined potential to the data limes along with a sequential driving voltage having a polarity that is inverted for each frame of the image signal with respect to the predetermined potential; and a scanning line driving circuit that supplies a scanning signal through the plurality of scanning lines.

With the apparatus for driving the electro-optical device according to the invention, if various signals, such as a power signal, a data signal, and a control signal, are input or output during operation, the scanning signals are sequentially supplied to the plurality of scanning lines by the scanning signal driving circuit. Simultaneously, the image signals are sequentially supplied to the plurality of data lines by the data line driving circuit. As a result, the driving voltage corresponding to the image signal is applied to the pixels arranged to correspond to intersection of the plurality of scanning lines and the plurality of data lines. The electro-optical operation of, for example, a liquid crystal display is carried out, for example, by changing an orientation state of an electro-optical substance contained in the pixel part and controlling the light transmission rate of each pixel part. The driving voltage corresponding to the image signal is applied by driving frame reversion, in which the polarity of the driving voltage is reversed, so that the driving voltage corresponding to the image signal acts on the electro-optical substance interposed between substrates so as to prevent burn-in from occurring in the displayed image.

Another aspect of the invention, is a method for driving the electro-optical device described above and still another aspect of the invention is an electro-optical device which includes the driving circuit described above.

Since the electro-optical device of the invention includes the driving apparatus of the invention described above, it is possible to display a high quality image in each pixel part, without following the variation of the response characteristic.

The operation and other benefits of the invention will now be apparent from the following description.

BRIEF DESCRIPTION OF THE DRAWINGS

The invention will be described with reference to the accompanying drawings, wherein like numbers reference like elements.

FIG. 5 is a table showing a driving pattern in each frame of an electro-optical device according to the first embodiment;

FIG. 9 is a table showing a relation between amplitude and polarities of a correction voltage in an electro-optical device according to the first embodiment, and the size of crosstalk on a displayed image.

DESCRIPTION OF EXEMPLARY EMBODIMENTS

Figure 1:
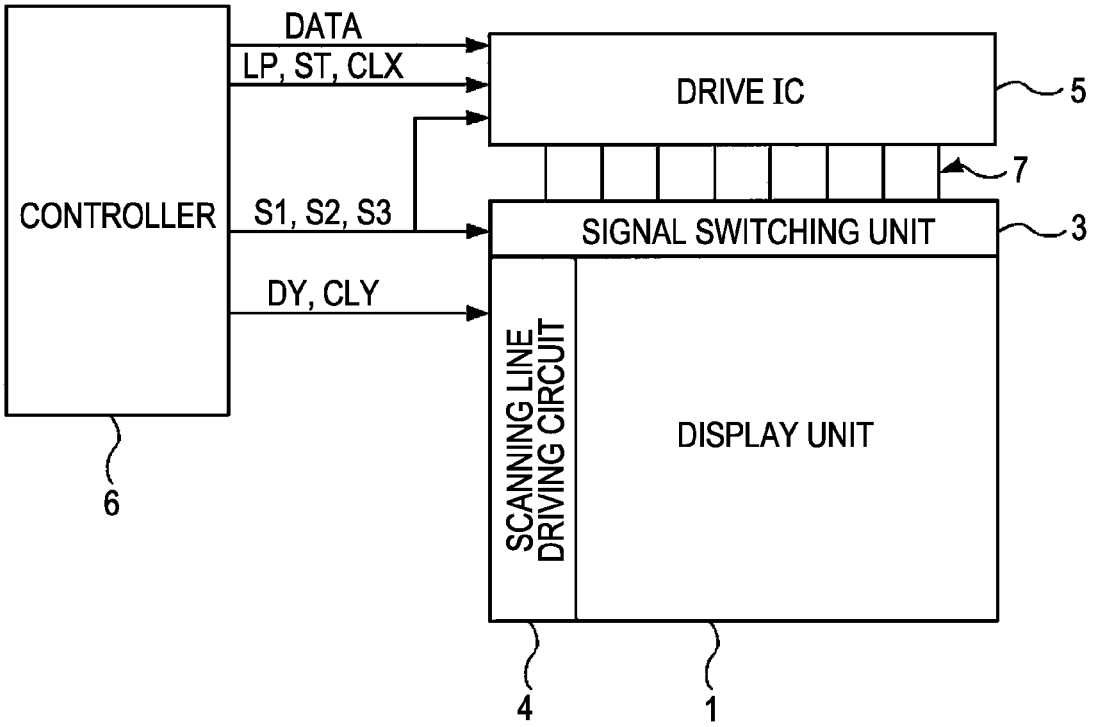
FIG. 1 is a block diagram showing an electrical configuration of an electro-optical device according to a first embodiment of the invention.

As used herein, the term "pulsed" describes a correction voltage which is shorter than a period of reversing the polarity of the driving voltage, that is, the correction voltage is locally left on a time axis for one reversion period of the driving voltage. Accordingly, the pulse of the correction voltage is sufficiently short as compared with the response time of the liquid crystal. The correction voltage is different from the driving voltage having the polarity which is reversed for every frame, and has a polarity which is fixed at either positive polarity or a negative polarity during operation of the driving apparatus.

As described more fully below, the driving apparatus for the electro-optical device which is driven by driving frame reversion described herein can reduce the unevenness of displayed image by applying the correction voltage at the timing ahead of the at least image signal, with the frame being reversed during driving of the apparatus.

As used herein, the term "at least timing ahead of the image signal" means a time in a blanking period of vertical scanning or a blanking period of horizontal scanning according to the image signal. For example, the term "at least", a single timing ahead of one image signal for every frame is enough, but the timing ahead of the image signal in each of the plurality of horizontal periods (i.e., a horizontal scanning period) in one frame, that is, in all the time within every frame, may be in effect. Also, in the case where plurality of frames are regarded as one time unit, timing ahead of the image signal to be applied within the corresponding time unit may be possible. Differently from the image signal, the correction voltage is generally applied to the plurality of data lines in unison.

In some embodiments described below, the correction signal is not applied between the pixel electrode and the opposite electrode due to the existence of switching elements or the like, which are in a turned-off state, provided in each pixel part, similar to the image signal (i.e., the driving voltage corresponding thereto). The potential of the data line is changed to or approximated to the value of the correction voltage by using a conventional image signal (that is, the driving voltage corresponding thereto) to carry out an electrical task. Otherwise, even though the correction signal is applied between the pixel electrode and the opposite electrode due to the existence of switching elements which are provided in each pixel part and are in a turned-on state, similar to the image signal (that is, the driving voltage corresponding thereto), the period, in which the voltage corresponding to the image signal is held at the pixel electrode, may be regarded as somewhat expendable. However, the potential of the data lines and the pixel electrodes is changed to or approximated to a value of the correction voltage from the value of the image signal (that is, the driving voltage corresponding thereto) to carry out the electrical task.

In the electro-optical device described below, the pixel parts, which are placed at different areas of an image display region, have parasitic capacitance of different sizes depending upon the transmission distance of driving voltage. For this reason, even if the pixels are connected to the same data line, the value of the driving voltage actually applied to the pixel part is varied. In the driving apparatus provided in the electro-optical device irradiated by strong light from, for example, a liquid crystal projector, since current leakage is likely to be generated by irradiation of light onto a thin film transistor provided in the driving apparatus in order to control the switching of the pixel electrode, there is a difference between the driving voltages applied between the pixel parts described above. After the image signal is supplied, the driving apparatus according to the invention compensates a potential difference between the plurality of data lines or compensates a difference between the driving voltage values, due to at least the difference between the driving voltage values, and applies the correction voltage to the plurality of data lines at timing ahead of the image signal for every frame. Therefore, it is possible to reduce a difference between the driving voltages supplied or applied via the next data line and produced at the pixel, and thus to the suppress occurrence of the burn-in in the displayed image.

According to the invention, in particular, the correction voltage has a predetermined polarity. As used herein, the term "predetermined polarity" means either a positive polarity or a negative polarity. That is, the correction voltage has constantly either a positive polarity or a negative polarity, irrespective of the driving voltage corresponding to the image signal having a polarity which is reversed for every frame. In this regard, the correction voltage according to the invention is a voltage having a property different from that of a so-called pre-charge voltage, so that the polarity is reversed according to the polarity of the driving voltage. That is, since the correction voltage according to the invention is applied or supplied before the image signal, a kind of pre-charge signal may be perceived as the timing, but the correction voltage having a predetermined polarity (that is, constantly having either the positive polarity or the negative polarity) is different. In the case of the existing pre-charge signal, it is necessary to previously write data with the same polarity as that of the voltage of a next image signal to be written, due to the object of reducing the writing load of the image signal.

As used herein, the term "predetermined selection order" may include a selection order in which the data lines included in a specified block are selected one by one, a selection order in which the data lines in the block are selected in random order, and a selection order in which all of the data lines in the block are selected within one horizontal period. The order (i.e., a predetermined selection order), in which the data lines included in the block are selected, may be changed by the selection order control unit. For example, the selection order may be changed every frame, or may be changed for every one horizontal period.

Since the electronic apparatus of the invention includes the electro-optical device according to the invention, various electronic apparatuses capable of displaying a high quality image, such as a projection-type display device, a cellular phone, an electronic scheduler, a word processor, a viewfinder-type or a monitor-type video tape reorder, a workstation, a television phone, a POS terminal, a touch panel, and so forth, can be achieved. Also, the liquid crystal device described includes an electrophoresis apparatus such as an electronic paper.

An embodiment of the invention will now be described with reference to accompanying drawings.

Liquid Crystal Apparatus

Figure 2:
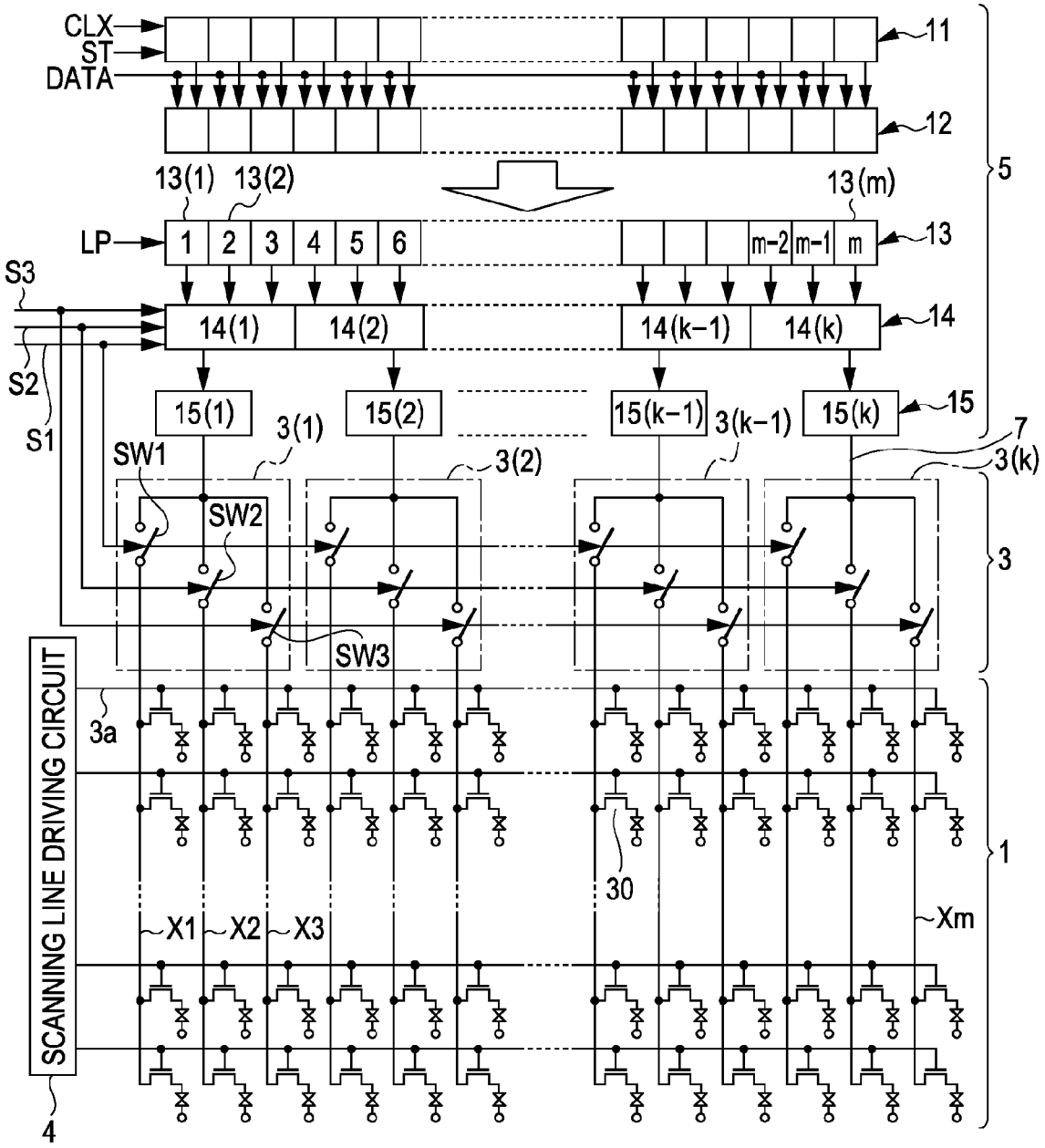
FIG. 2 is a circuit diagram of a switching unit and a driver IC in an electro-optical device according to the first embodiment.

A liquid crystal apparatus employing a thin film transistor (hereinafter referred to as a TFT) is described below with reference to FIGS. 1 and 2. The liquid crystal apparatus is one example of an electro-optical device and associated driving unit which is capable of performing aspects of the invention. FIG. 1 is a block diagram showing the electrical configuration of the liquid crystal apparatus. FIG. 2 is a block diagram showing a detailed circuit configuration of a display unit 1, a signal switching unit 3, a data supply line 7, and a driver IC 5, which are shown in FIG. 1.

The display unit 1 is a matrix display unit including pixels of n columns×m rows, where n and m are integers. The resulting matrix display unit has a resolution of m×n by arranging the matrix wiring so as to have m pixels in an X direction and n pixels in a Y direction. The display unit 1 is connected to the data supply line 7 via the signal switching unit 3, and is supplied with an image signal from the driver IC 5, so that an image corresponding to the image signal is displayed on the display unit 1.

As shown in FIG. 2, the display unit 1 is provided with m data lines X (X1, X2, X3, . . . , Xm) for supplying the image signal to each pixel, the data lines are divided into k blocks each having three blocks. Each block of the data lines X is supplied from the driver IC 5 with the image signal through the data supply line 7. In other words, an image signal for m pixels arrayed in one horizontal line (i.e., the X direction in FIGS. 1 and 2) is converted into a form suitable for the k drive circuits, which correspond to each block of the data line X by the driver IC 5. The signal output from the driver IC 5 is sorted into each data line by the signal switching unit 3, so that the image signal can be supplied to all of the data lines X. The liquid crystal device according to the invention divides all of the data lines X into a plurality of blocks, and drives the image display by performing dot sequential drives for each of these blocks. These dot sequential drives are each hereinafter referred to as block dot sequential drives.

Figure 3:
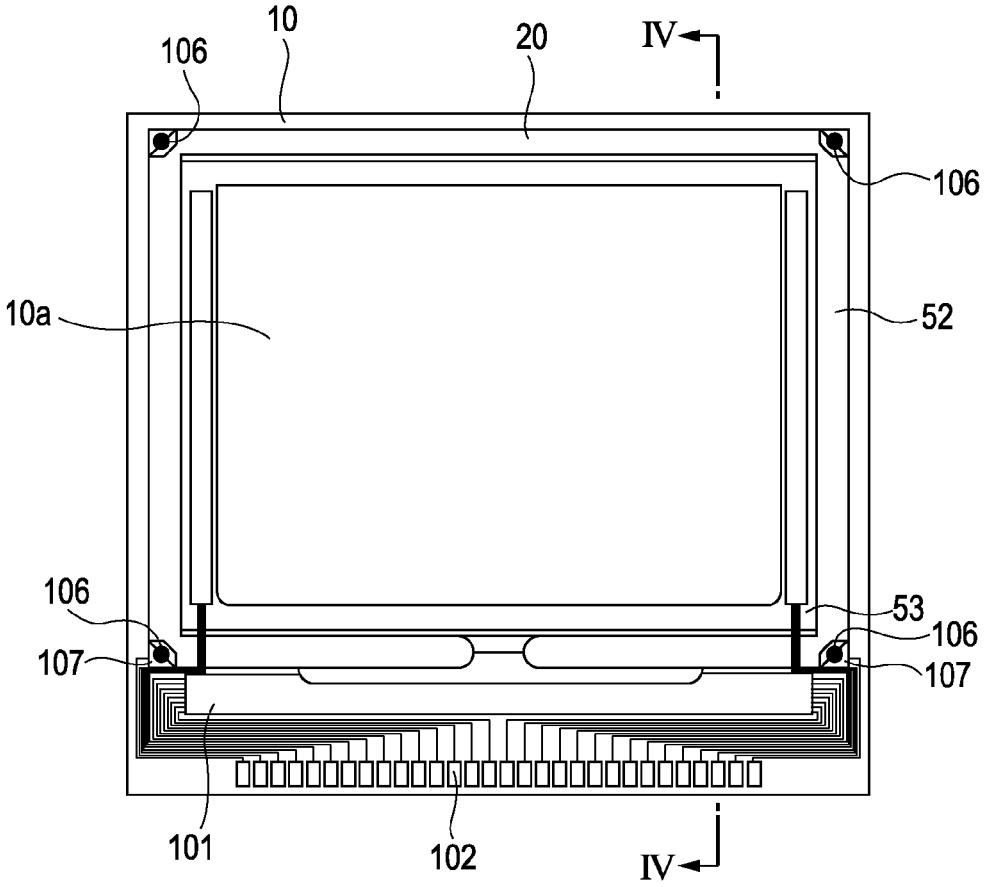
FIG. 3 is a view schematically showing a detailed configuration around a display unit of an electro-optical device according to the first embodiment.
Figure 4:
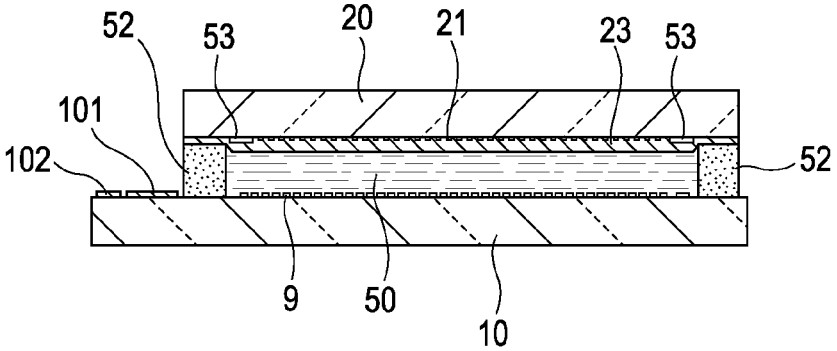
FIG. 4 is a cross-sectional view taken along the line IV-IV in FIG. 3.

The configuration around the display unit 1 of the liquid crystal device according to the embodiment will now be described with reference to FIGS. 3 and 4. FIG. 3 is a view schematically showing a configuration around the display unit 1 of the liquid crystal device according to the first embodiment. FIG. 4 is a cross-sectional view taken along the line IV-IV in FIG. 3.

In FIGS. 3 and 4, in the liquid display device according to the first embodiment of the invention, a TFT array substrate 10 and an opposite substrate 20 are placed to face each other. The TFT array substrate 10 is, for example, a transparent substrate, such as a quartz substrate, glass substrate, or silicon substrate. The opposite substrate 20 is a transparent substrate, such as quartz substrate or glass substrate. A liquid crystal layer 50 is sealed between the TFT array substrate 10 and the opposite substrate 20. The TFT array substrate 10 and the opposite substrate 20 are bonded to each other by a sealing member 52 provided at a sealing area which is around an image display area 10*a* in which a plurality of pixel electrodes are provided.

The sealing member 52 is made of, for example, a ultraviolet ray curable resin or heat curable resin for bonding both substrates to each other, and is formed by curing the resin using ultraviolet rays or heat after the resin is coated on the TFT array substrate 10 in a manufacturing process. Gap members, such as glass fiber or glass beads, are dispersed in the sealing member 52 in order to maintain a predetermined gap (i.e. an inter-substrate gap) between the TFT array substrate 10 and the opposite substrate 20.

A frame-shaped light shielding film 53 is provided on the opposite substrate 20. The light shielding film 53 has a light shielding property which defines a predetermined area 10*a* disposed inside a sealing area, where the sealing member 52 is placed. Although in this embodiment the light shielding film 53 is described as being disposed on the opposite substrate 20, part or the entire portion of the frame-shaped light shielding film 53 may be disposed on the TFT array substrate 10 side.

An external circuit connection terminal 102 is connected to an external circuit in order to supply the image signal corresponding to an image to be displayed on the image display area 10*a*. The image signal input to the external connection terminal 102 is processed by a data line driving circuit 101 including the controller 6, the driver IC 5, and the signal switching unit 3, which are shown in FIG. 1.

On the TFT array substrate 10, upper and lower conduction terminals 106 for connecting the substrates to each other by interlayer conduction members 107 are placed at positions facing four corners of the opposite substrate 20, respectively. With such a structure, it is possible to enable the TFT array substrate 10 and the opposite substrate 20 to conduct electricity.

In FIG. 4, a laminated structure is formed on the TFT array substrate 10, including a TFT 30 for performing pixel switching or wiring, such a data line. A pixel electrode 9 made of a transparent conductive film, such as ITO (Indium Tin Oxide) film, is formed in a matrix shape on the wiring including the TFT for performing the pixel switching or the wiring such as a scanning line and a data line in the pixel display area 10*a*. An aligning film (not shown in FIG. 4) is formed on the pixel electrode 9. Meanwhile, a black matrix 23 is formed on the surface of the opposite substrate 20 which is opposite to the TFT array substrate 10. The black matrix 23 is made of, for example, a light shield metal film, and is patterned in the image display area 10*a* over the opposite substrate 20, for example, in a lattice form or a striped form. An opposite electrode 21 made of a transparent material, such as ITO, is formed on the light shield film 23 opposite to the plurality of pixel electrodes 9, and is placed (e.g., in a solid shape) over the entire surface of the opposite substrate 20. The aligning film is formed on the opposite electrode 21.

A liquid crystal layer 50 is formed between the TFT array substrate 10 and the opposite substrate 20 and is placed in such a manner that the pixel electrodes 9 and the opposite electrode 21 face each other as described above. The liquid crystal layer 50 is made up of liquid crystals in which one kind or several kinds of magnetic liquid crystals are mixed, and the liquid crystals are aligned in a predetermined orientation between the pair of aligning films.

As shown in FIGS. 3 and 4, in addition to the data line driving circuit 101, on the TFT array substrate 10 may be provided a pre-charge circuit which supplies a pre-charge signal having a predetermined voltage level to the plurality of data lines before the image signals are supplied to the data lines, a test circuit which tests quality and defects of the electro-optical device which is being manufactured or shipped, an inspection pattern or the like.

Again returning to FIG. 1, the controller 6 supplies an image signal DATA, a latch timing signal LP, a start signal ST of a shift resistor, a data clock signal CLX, and select signals S1, S2 and S3 to the driver IC 5. Also, the controller 6 supplies a start signal DY of the scanning line driving circuit 4 and a scan clock signal CLY to the scanning line driving circuit 4. Meanwhile, although the driver IC 5 shown in FIG. 1 includes a shift resistor unit 11, first and second latch circuits 12 and 13, and a selector unit 14 and a driver unit 15, which will be described below with reference to FIG. 2, a part or all of them may be integrally formed with the display unit 1. The controller and the driver IC may be integrally collected, or a part of the function of the controller may be assembled into the driver IC.

As shown in FIG. 2, the driver IC 5 includes the shift resistor unit 11, the first latch circuit 12, the second latch circuit 13, the selector unit 14, and the driver unit 15. The driver unit 15 of the driver IC 5 is connected to the signal switching unit 3 via the data supply line 7 which transmits the converted image signal for each block.

The shift resistor unit 11 is input with the data clock signal CLX and the start signal ST. The start signal ST is shifted into the shift resistor unit 11 in synchronization with the data clock signal CLX. The output signal from each unit resistor of the shift resistor unit 11 is respectively input to a series of unit latch circuits constituting the first latch circuit 12. The image signal DATA which is an image signal is simultaneously supplied to all unit latch circuits of the first latch circuit 12. If an output signal is input from the unit resistor, the image signals DATA are accumulated in each unit latch circuit of the first latch circuit 12 by turns. The m image signals DATA for one line, that is, for one horizontal scanning line, are accumulated in the first latch circuit 12. The image signal DATA is, for example, 6-bit digital signal.

The second latch circuit 13 is a circuit for latching the image signal DATA of the first latch circuit 12 intact in accordance with a latch timing signal LP. Accordingly, m data for one line are simultaneously latched in the second latch circuit 13. Each of the latch circuits 13(1), 13(2), . . . , and 13(*m*) of the second latch circuit 13 latches the image signal corresponding to the data lines X1, X2, . . . , and Xm.

The selector unit 14 includes a plurality of select circuits 14(1), 14(2), . . . , and 14(*k*). A plurality of groups (blocks) are formed by dividing the image signals DATA for one line into data corresponding to three pixels which are consecutive from the start or the end of the data for one line. Three data of each group are input to each corresponding select circuit 14(*k*). More specifically, the select circuit 14(1) is input by 1, 2 and 3 image signals DATA, the select circuit 14(2) is input by 4, 5 and 6 image signals DATA, and the select circuit 14(*k*) is input by (m−2), (m−1) and m image signals DATA. The selector unit 14 is supplied by the select signals S1, S2 and S3, and each select circuit 14(*k*) selects one previously predetermined image data among three input image data in accordance with the select signals S1, S2 and S3, and supplies the selected image data to the driver circuit corresponding to the driver unit 15 as an output signal.

The driver unit 15 includes the plurality of drive circuits 15(1), 15(2), . . . , 15(*k*). For example, when the select signal S1 is supplied, the select circuit 14(1) outputs the image signal DATA1 to the driver circuit 15(1), the select circuit 14(2) outputs the image signal DATA4 to the driver circuit 15(2), and the select circuit 14(*k*) outputs the image signal DATA(m−2) to the driver circuit 15(*k*). Each drive circuit 15 is a circuit including, for example, a digital-to-analog converter, an amplification circuit or the like.

The image signal DATA analog-converted by each driver circuit 15 is supplied to the signal switching unit 3 via the k data supply lines 7. The signal switching unit 3 includes a plurality of signal switching circuits 3(1), 3(2), . . . , 3(*k*). Each signal switching circuit has three switch circuits SW1, SW2 and SW3. The image signal DATA supplied from each driver circuit is supplied to one end of three switch circuits SW1, SW2 and SW3 of the corresponding signal switching circuit. The other end of each switch circuit, which is an output, is connected to the corresponding data lines X1, X2, . . . , and Xm of the data line group in a direction X of the pixel 2. The signal switching unit 3 is supplied by the select signals S1, S2 and S3 for turning the each switch circuit on or off. Each of the switch circuits SW1, SW2 and SW3 of the signal switching unit 3 are selectively sequentially turned on in accordance with the select signals S1, S2 and S3, and sequentially supplies the image signal DATA to the corresponding data line from the corresponding drive circuit.

For example, when the select signal S1 to turn on the switch circuit SW1 is supplied, the switch circuit SW1 of the signal switching circuit 3(1) is turned on, and the image signal corresponding to the image signal DATA1 is output to the data line X1. Similarly, the switch circuit SW1 of the signal switching circuit 3(2) is turned on, and the image signal corresponding to the image signal DATA4 is output to the data line X4. Similarly, the switch circuit SW1 of the signal switching circuit 3(*k*) is turned on, and the image signal corresponding to the image signal DATA(m−2) is output to the data line X(m−2).

Also, for example, when the select signal S2 to turn on the switch circuit SW2 is supplied, the switch circuit SW2 of the signal switching circuit 3(1) is turned on, and the image signal corresponding to the image signal DATA2 is output to the data line X2. Similarly, the switch circuit SW2 of the signal switching circuit 3(2) is turned on, and the image signal corresponding to the image signal DATA5 is output to the data line X5. Similarly, the switch circuit SW2 of the signal switching circuit 3(*k*) is turned on, and the image signal corresponding to the image signal DATA(m−1) is output to the data line X(m−1).

When the select signal S3 to turn on the switch circuit SW3 is supplied, the switch circuit SW3 of the signal switching circuit 3(1) is turned on, and the image signal corresponding to the image signal DATA3 is output to the data line X3. Similarly, the switch circuit SW3 of the signal switching circuit 3(2) is turned on, and the image signal corresponding to the image signal DATA6 is output to the data line X6. Similarly, the switch circuit SW3 of the signal switching circuit 3(*k*) is turned on, and the image signal corresponding to the image signal DATAm is output to the data line Xm.

As described above, each signal switching circuit is switched by turning on the predetermined switching circuits SW1, SW2 and SW3 in accordance with the select signals S1, S2 and S3 to sequentially select the image signal from each drive circuit 15 and output the selected image signal to the corresponding data line. Each of the switch circuits SW1, SW2 and SW3 is sequentially turned on in one horizontal period (that is, in a horizontal scan period), and the image signal is supplied to all of the data lines in all blocks in one horizontal period. Accordingly, dot sequential drive is performed for every block constituted by three data lines.

In particular, the embodiment is constructed so as to alter the order of turning on the switch circuits SW1, SW2 and SW3 on a time axis, for example, for every line, by adjusting the timing at which the select signals S1 to S3 are output from the controller 6.

For example, the switch circuits SW1, SW2 and SW3 are sequentially turned on in the order of the switch circuits SW1, SW2 and SW3 in any one horizontal period by the select signals S1 to S3, where the image signal is first supplied to the data lines X1, X4, X7, ( . . . ), the image signal is supplied to the data lines X2, X5, X8, ( . . . ), and finally the image signal is supplied to the data lines X3, X6, X9, ( . . . ). Subsequently, if the switch circuits SW1, SW2 and SW3 are sequentially turned on in the order of, for example, the switch circuits SW2, SW1 and SW3 in the next horizontal period by adjusting the timing where the select signals S1 to S3 are output from the controller 6, the image signal can be first supplied to the data lines X2, X5, X8, ( . . . ), the image signal can be supplied to the data lines X1, X4, X7, ( . . . ), and finally the image signal can be supplied to the data lines X3, X6, X9, ( . . . ).

In particular, the embodiment is constructed so as to alter the order that the switch circuits SW1, SW2 and SW3 are turned on in every horizontal period. More specifically, as shown in FIG. 5, a first pattern (S1, S2, S3), a second pattern (S2, S3, S2) and a third pattern (S3, S1, S2) alternate for every horizontal period in three consecutive frame periods by the controller 6.

Figure 6:
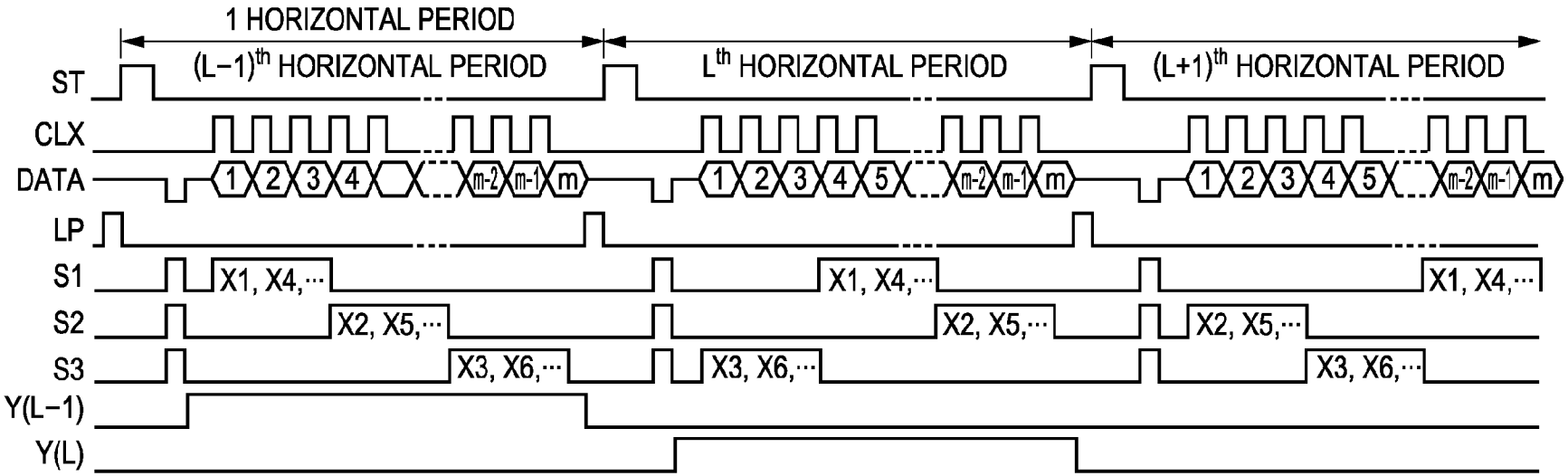
FIG. 6 is a timing chart showing the input/output timing of various signals associated with image display in an electro-optical device according to the first embodiment.

FIG. 6 is a timing chart showing an input/output timing of each signal in the above-described circuit configuration. FIG. 6 depicts the timing chart of a start pulse St, a data clock signal CLX, a latch timing signal LP, the select signals S1, S2 and S3, a scan side start signal DY, and a scan side shift signal CLY in the circuit configuration shown in FIG. 2.

In the display unit 1, the image signals DATA1, DATA2, . . . , and DATAm corresponding to each pixel are supplied to the first latch circuit 12 at a transmission rate corresponding to the data clock CLX. The start pulse ST shifts sequentially the shift resister unit 11 in response to the data clock CLX, which supplies a latch pulse to latch each pixel of the first latch circuit 12. Therefore, each unit latch latches sequentially the image signals DATA1, DATA2, . . . , and DATAm corresponding to each pixel of horizontal direction of the pixel unit 2.

The image signals DATA1, DATA2, . . . , and DATAm for one line of the first latch circuit 12 are latched to the second latch circuit 13 at the timing of the latch timing signal LP, and the latched data is output. The image data for one line output from the second latch circuit 13 is written into each pixel electrode of the scanning line which is turned on by the gate signal, within one horizontal period.

In the period in which the scanning line of the $(L-1)^{th}$ line in the $n^{th}$ column, that is, the $(L-1)^{th}$ horizontal period, the scanning line corresponding to the scanning signal Y(L−1) of a signal waveform shown in FIG. 6 is output. In the $(L-1)^{th}$ horizontal period, the scanning line Y (L−1) is set to a high level (hereinafter referred to as HIGH) while the image data DATA is applied to the data line. In particular, the scanning signal Y (L−1) is a high level immediately after a pulsed correction voltage having a negative polarity which will be described hereinafter is input. Since the scanning signal Y becomes a high level at such timing, it prevents the displayed image from being distorted by directly applying the correction voltage to the pixel electrode. When the pulsed correction voltage having the negative polarity does not affect the orientation state of the liquid 50 interposed between the substrates, for example, in the case of the correction voltage with short pulse width at a short application time, the scanning signal Y may be set to a high level before the correction voltage is input, since the displayed image is hardly distorted even though the correction voltage is applied to the pixel electrode.

The image data for one pixel from the second latch circuit 13 is divided into k adjacent blocks each having three pixels, and the image data for one pixel of each block is selected by the select circuits 14(1), 13(2), . . . , and 14(*k*). The selection is performed based on the selection signals S1, S2 and S3. The select signals S1, S2 and S3 are signals which become HIGH only in about ⅓ period of one horizontal period, as shown in FIG. 4. The select circuits 14(1), 14(2), . . . , and 14(*k*) select the image data for one pixel of each group according to the HIGH state of the select signals S1, S2 and S3.

That is, the select circuits 14(1), 14(2), . . . , and 14(*k*) select and output the image signals DATA1, DATA4, DATA7, ( . . . ) of the pixels (1), (4), (7), ( . . . ) according to the HIGH state of the select signal S1, select and output the image signals DATA2, DATA5, DATA8, ( . . . ) of the pixels (2), (5), (8), ( . . . ) according to the HIGH state of the select signal S2, and select and output the image signals DATA3, DATA6, DATA9, ( . . . ) of the pixels (3), (6), (9), ( . . . ) according to the HIGH state of the select signal S3.

The image data from the select circuit 14(1), 14(2), . . . , and 14(*k*) are converted into analog signals and amplified by the drive circuits 15(1), 15(2), . . . , 15(*k*), and then are supplied to the signal switching circuits 3(1), 3(2), . . . , 3(*k*). The signal switching circuits 3(1), 3(2), . . . , and 3(*k*) branch the input image data to the data lines X1, X2, ( . . . ), respectively.

The signal switching circuits 3(1), 3(2), . . . , and 3(*k*) are controlled by the select signals S1, S2 and S3 to output one input to one of three outputs. In other words, the signal switching circuits 3(1), 3(2), . . . , and 3(*k*) output the image data to the first output among three outputs during the HIGH state of the select signal S1, output the image data to the second output among three outputs during the HIGH state of the select signal S2, and output the image data to the third output among three outputs during the HIGH state of the select signal S3.

That is, in the period in which the select signal S1 is HIGH, the image data selected by the select circuits 14(1), 14(2), . . . , and 14(*k*) are supplied to the data lines X1, X4, X7, ( . . . ). In the period in which the select signal S2 is HIGH, the image data selected by the select circuits 14(1), 14(2), . . . , and 14(*k*) are supplied to the data lines X2, X5, X8, ( . . . ). And, in the period in which the select signal S3 is HIGH, the image data selected by the select circuits 14(1), 14(2), . . . , and 14(*k*) are supplied to the data lines X3, X6, X9, ( . . . ).

As described above, in the first approximately ⅓ period of the $(L-1)^{th}$ horizontal period shown in FIG. 6, the image signal DATA1, DATA4, DATA7, ( . . . ) are supplied to the data lines X1, X4, X7, ( . . . ) according to the HIGH state of the select signal S1. In the $(L-1)^{th}$ horizontal period, the scanning signal YL−1 becomes HIGH, and each of the $1^{st}$, $4^{th}$, $7^{th}$, ( . . . )$^{th}$ TFTs 16 of the scanning line L−1 is supplied by the image signals DATA1, DATA4, DATA7, ( . . . ) via the data lines X1, X4, X7, ( . . . ). After that, the writing of the data into the pixel electrode is performed until the $(L-1)^{th}$ horizontal period ends.

In the next approximately ⅓ period of the $(L-1)^{th}$ horizontal period, the image signal DATA2, DATA5, DATA8, ( . . . ) are supplied to each of the $2^{nd}$, $5^{th}$, $8^{th}$, ( . . . )$^{th}$ TFTs 16 of the scanning line L−1 via the data lines X2, X5, X8, ( . . . ) according to the HIGH state of the select signal S2. After that, the writing of the data into the pixel electrode is performed until the $(L-1)^{th}$ horizontal period is terminated. Also, in the final approximately ⅓ period of the $(L-1)^{th}$ horizontal period, the image signal DATA3, DATA6, DATA9, ( . . . ) are supplied to each of the $3^{rd}$, $6^{th}$, $9^{th}$, ( . . . )$^{th}$ TFTs 16 of the scanning line L−1 via the data lines X3, X6, X9, ( . . . ) according to the HIGH state of the select signal S3. After that, the writing of the data into the pixel electrode is performed until the $(L-1)^{th}$ horizontal period ends.

In this manner, after the timing in which each TFT 16 of the scanning line L−1 is input with the image data via the data lines, the writing of the data into the pixel electrode is performed by supply of the image data, until the scanning signal Y becomes a low level (hereinafter referred to as LOW). Accordingly, a writing period for writing data into the pixel electrode via the data lines X1, X4, X7, ( . . . ) is an about 1H (horizontal) period, a writing period for writing data into the pixel electrode via the data lines X2, X5, X8, ( . . . ) is an about (⅔)H period, and a writing period of writing data into the pixel electrode via the data lines X3, X6, X9, ( . . . ) is an about (⅓)H period.

After that, in the similar manner, the image data selected on the basis of the select signals S1, S2 and S3 is supplied to the corresponding to data line, and are written into the pixel electrode via the TFT 16 which is turned on.

In this embodiment, in the next $L^{th}$ horizontal period, the order of the data lines performing the writing of the image data is set to be different from that of the $(L-1)^{th}$ horizontal period. In other words, as shown in the second column of FIG. 6, in the $L^{th}$ horizontal period in which the gate signal YL is HIGH, the select signal S3 becomes HIGH in the first approximately ⅓ period of one horizontal period, the select signal S1 becomes HIGH in the next approximately ⅓ period, and the select signal S2 becomes HIGH in the final approximately ⅓ period.

Accordingly, the writing of the data into the pixel electrode through the data line X3, X6, X9, ( . . . ) is performed during the about 1H period from the beginning of the $L^{th}$ horizontal period, the writing of the data into the pixel electrode via the data line X1, X4, X7, ( . . . ) is performed during the about (⅔)H period on the way of the $L^{th}$ horizontal period, and the writing of the data into the pixel electrode via the data lines X2, X5, X8, ( . . . ) is performed during the about (⅓)H period at the last of the $L^{th}$ horizontal period.

In the $(L+1)^{th}$ horizontal period, the select signal S2 becomes HIGH in the first approximately ⅓ period of one horizontal period, the select signal S3 becomes HIGH in the next approximately ⅓ period, and the select signal S1 becomes HIGH in the final approximately ⅓ period.

In this case, the writing of the data into the pixel electrode through the data line X2, X5, X8, ( . . . ) is performed during approximately 1H period from the beginning of the $(L+1)^{th}$ horizontal period, the writing of the data into the pixel electrode via the data line X3, X6, X9, ( . . . ) is performed during approximately the (⅔)H period on the way of the $(L+1)^{th}$ horizontal period, and the writing of the data into the pixel electrode via the data lines X1, X4, X7, ( . . . ) is performed during approximately the (⅓)H period at the last of the $(L+1)^{th}$ horizontal period. By repeating this process, the matrix display of n columns×m rows (n and m are integer numbers) takes place in the display apparatus.

Eventually, in the three horizontal periods from the $(L-1)^{th}$ horizontal period to the $(L+1)^{th}$ horizontal period, the writing of the data into the pixel electrode via the data lines X1, X4, X7, ( . . . ) is performed during a total of approximately 2H, the writing of the data into the pixel electrode via the data lines X2, X5, X8, ( . . . ) is performed during a total of approximately 2H, and the writing of the data into the pixel electrode via the data lines X3, X6, X9, ( . . . ) is also performed during a total of approximately 2H.

After that, the select signals S1, S2 and S3 repeat the same pattern in a cycle of three horizontal periods. In other words, seen from the standpoint of three constant consecutive horizontal periods, that is, three consecutive lines, the writing period of writing the data into each pixel electrode is equal in the writing period of any data lines. Therefore, since luminance unevenness occurring in each line is equalized every three lines, it is possible to display the image with no luminance unevenness as a whole.

In this embodiment, when the dot sequential drive in each block is performed, the timing of supplying the image data to each data line in the block is switched for every line, and the writing period of writing the data into the pixel electrode is equalized by the plurality of lines. Therefore, luminance variation in the screen due to the writing period is averaged for the plurality of lines by distribution between the pixels of the same luminance, so that it is difficult to see any display unevenness.

In this embodiment, by changing all timings of the select signals S1, S2 and S3 and returning the developmental pattern of the select signals S1, S2 and S3 to the original state in three horizontal periods, the writing period of the pixel electrode is equalized in the three horizontal periods. However, the time period of equalizing the writing period is not limited to three horizontal periods. Also, the developmental pattern of the select signal is not limited to that shown in FIG. 5, and may be changed in various shapes.

Even if not all timings of the select signals S1, S2 and S3 are changed and only any one or two timing are changed, almost the same effect can be obtained. For example, in the state where the developmental pattern of the select signal S2 is not changed, the developmental pattern of the select signals S1 and S3 may be changed in a cycle of one horizontal period. In this instance, the writing period of all pixels may be equalized in two horizontal periods. In other words, if the developmental pattern of the select signals S1, S2 and S3 is changed on the time axis, the writing period of the pixel may be again equalized. In the case where the HIGH period of the select signals is set to a time shorter than ⅓ time of one horizontal period, as when the driving performance of the drive circuit is high, even though the timing of generating any one of the select signals S1, S2 and S3 is changed, some beneficial effects can be obtained.

Figure 7:
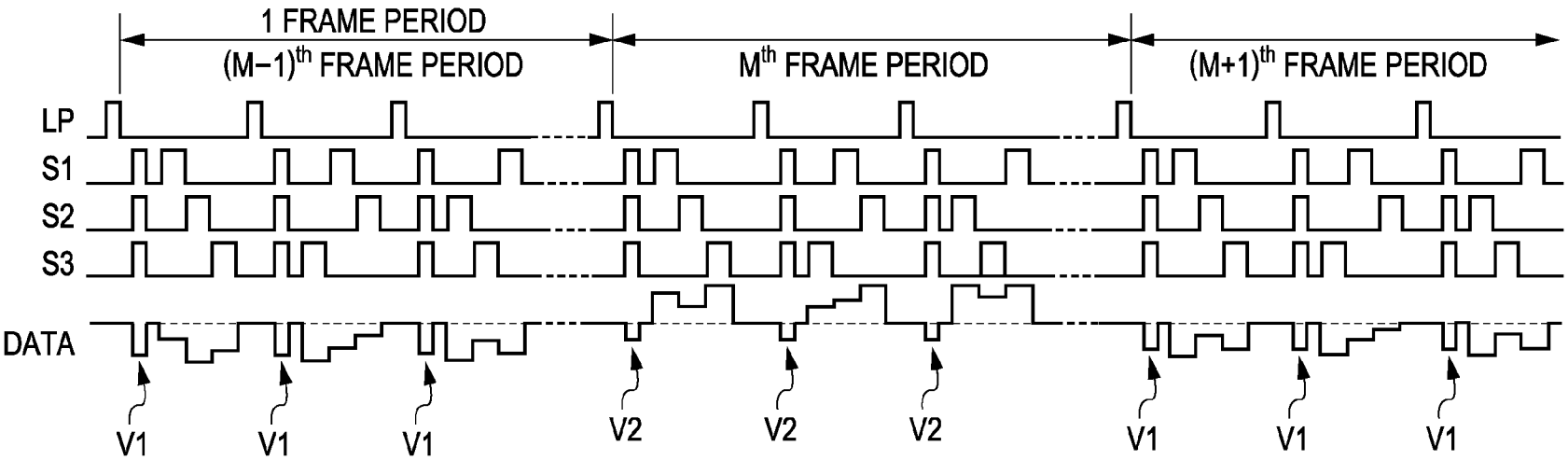
FIG. 7 is a timing chart showing the waveforms of a driving voltage and a correction voltage in a plurality of sequence frames of an electro-optical device according to the first embodiment.

FIG. 7 is a timing chart of outputting the image signal DATA including the latch timing signal LP, the select signals S1, S2 and S3, and the correction voltage over three consecutive frame periods (that is, over a $(M-1)^{th}$ frame period, an $M^{th}$ frame period, and a $(M+1)^{th}$ frame period). In particular, FIG. 7 shows concrete waveforms of the image signals DATA including the correction voltage. The correction voltage is indicated by an arrow in FIG. 7, and the waveforms which are not indicated by the arrow show the waveforms of the image signals DATA according to the displayed image.

As indicated by the arrow in FIG. 7, before the image signal DATA corresponding to "m" from the pixel 1 is supplied for every horizontal period, the pulsed correction voltage having a negative polarity is applied with respect to reference potential of the image signal DATA. That is, the pulsed correction voltage is overlapped and applied to the driving voltage corresponding to the image signal. Also, the time width of the correction voltage is set to be short in comparison with the voltage response time of liquid molecules constituting the liquid crystal layer which is disposed between the substrates (typically, the TFT array substrate and the opposite substrate) in the liquid crystal apparatus.

In the liquid crystal device according to the embodiment, in order to prevent burn-in of the liquid crystal layer provided in the display unit 1, the driving voltage applied to the liquid crystal layer, that is, the image signal DATA, is applied according to the displayed image is applied while the polarity is reversed for every frame period. In FIG. 7, the image signal DATA of a negative polarity is applied with respect to the reference voltage (indicated by a dotted line in FIG. 7) in the $(M-1)^{th}$ frame period. The negative polarity is reversed to a positive polarity with respect to the reference voltage in the next $M^{th}$ frame period. The positive polarity is reversed to the negative polarity with respect to the reference voltage in the next $(M+1)^{th}$ frame period.

Meanwhile, the correction voltage V overlapped and applied to the image signal DATA constantly has a negative polarity with respect to the reference voltage from the $(M-1)^{th}$ frame period to the $(M+1)^{th}$ frame period. In the $(M-1)^{th}$ frame period and the $(M+1)^{th}$ frame period in which the image signal DATA has the negative polarity, the applied correction voltage V (hereinafter referred to as a first correction voltage V1) has the same amplitude. In the $M^{th}$ frame period, the applied correction voltage V (hereinafter referred to as a second correction voltage V2) has an amplitude which is different from that of the first correction voltage V1. That is, the overlapped and applied correction voltage V1 is set to have a different magnitude depending on the polarity of the image signal DATA. Also, the first correction voltage V1 and the second correction voltage V2 are applied to all of the data lines, before the image signal DATA is supplied in each frame period. In other words, as shown in FIGS. 6 and 7, the select signals S1, S2 and S3 are set to reach a high level by the controller 6 at the timing in which the first correction voltage V1 and the second correction voltage V2 are supplied.

Figure 8:
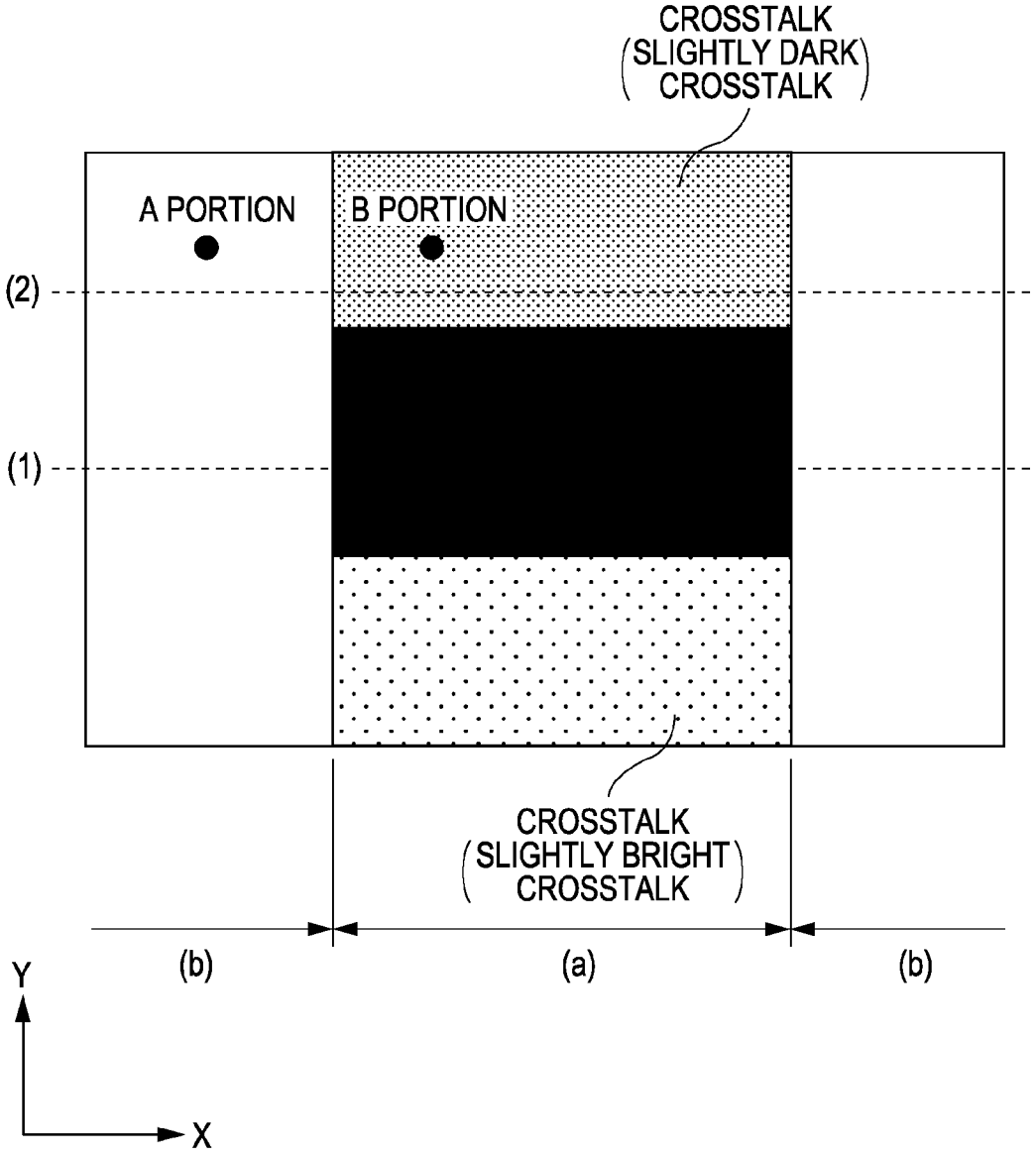
FIG. 8 is a view schematically showing unevenness occurring in a displayed image in the case where a correction voltage is not applied.

It was proved by way of experiment that the driving apparatus for the electro-optical device can reduce the unevenness of displayed image by applying the correction voltage V at timing ahead of the image signal DATA, with the frame being reversed during driving of the apparatus. In the case of displaying a black window pattern with middle background gradation by applying a driving voltage, A and B portions should be displayed at the same luminance, but if the correction voltage is not applied, there is a difference between the luminance of the A portion and the luminance of the B portion, as shown in FIG. 8, so that the display unevenness occurs. FIG. 8 is a view schematically showing the unevenness occurring in a displayed image when a correction voltage is not applied. Although not shown in FIG. 8, there are scanning lines and data lines in the X direction and the Y direction. First, when the scanning line to be driven is placed on a dotted line indicated by reference numeral (1), a specified driving voltage is applied to the data lines connected to the pixel placed in a section (a) so as to display the pixel in black. Since it is preferable that the data line connected to the pixel contained in a section (b) be displayed in white, the driving voltage is not applied to the data lines placed in the section, or the driving voltage which is significantly lower than that of section (a) is applied. In this instance, although the pixels located over the dotted line indicated by reference numeral (2) are not driven, the data lines connected to the corresponding to pixel in section (a) are applied with a high driving voltage, similar to the pixels placed over the dotted line indicated by the reference numeral (1), in comparison with section (b). In other words, due to the difference between the voltage applied to the data lines placed in portion A and the voltage applied to the data lines placed in portion B, the display unevenness occurs, as shown in FIG. 8. In particular, in the driving apparatus mounted in the electro-optical device irradiated by strong light, for example, current leakage is likely generated by irradiating light onto the thin film transistor 30, provided in the driving apparatus, for controlling the switching of the pixel electrode, and a display unevenness may easily occur, as described above. If there is a difference between the driving voltages applied to each pixel, display unevenness, that is, crosstalk, occurs on the displayed image, which causes reduction in image quality.

According to studies of the inventors, it was proved by way of experiment that the driving apparatus for the electro-optical device can reduce the unevenness of displayed image by applying the correction voltage V at the timing ahead of the image signal DATA, with the frame being reversed during the driving of apparatus. FIG. 9 is a table showing results by measuring the size of the crosstalk on the displayed image with respect to a variation between the amplitude of the first correction voltage V1 and the amplitude of the second correction voltage V2. In FIG. 9, the amplitude of the first correction voltage V1 was set to −4 V, while the amplitude of the second correction voltage V2 was varied. As a result, as compared with the case where the polarity of the second correction voltage V2 is positive, the crosstalk occurring at the negative polarity is small. That is, irrespective of the polarity of the image data applied to the pixel, it was proved by way of experiment that the size of the crosstalk can be reduced by applying the correction voltage having the negative polarity. In this example, it is preferable that the correction voltages V1 and V2 be voltages within the amplitude of the image data having the negative polarity, that is, a voltage between the maximum voltage and the minimum voltage in the image data having the negative polarity.

As describe above, the driving apparatus for the electro-optical device can be arranged to prevent the burn-in of the displayed image and occurrence of flicker, prevent the unevenness on the displayed image and thus enhance the image quality by applying correction voltage V at the timing ahead of the pixel signal DATA.

In this embodiment, although the invention was described using a configuration where a signal switching circuit is provided for a block with the plurality of scanning lines being divided into three scanning lines, the invention is not so limited. For example, the invention may be applied to a configuration where the signal switching circuit is provided for a block in which the plurality of scanning lines are divided into other numbers (e.g., 4, 8, 12, 16, or the like).

Electronic Apparatus

Figure 10:
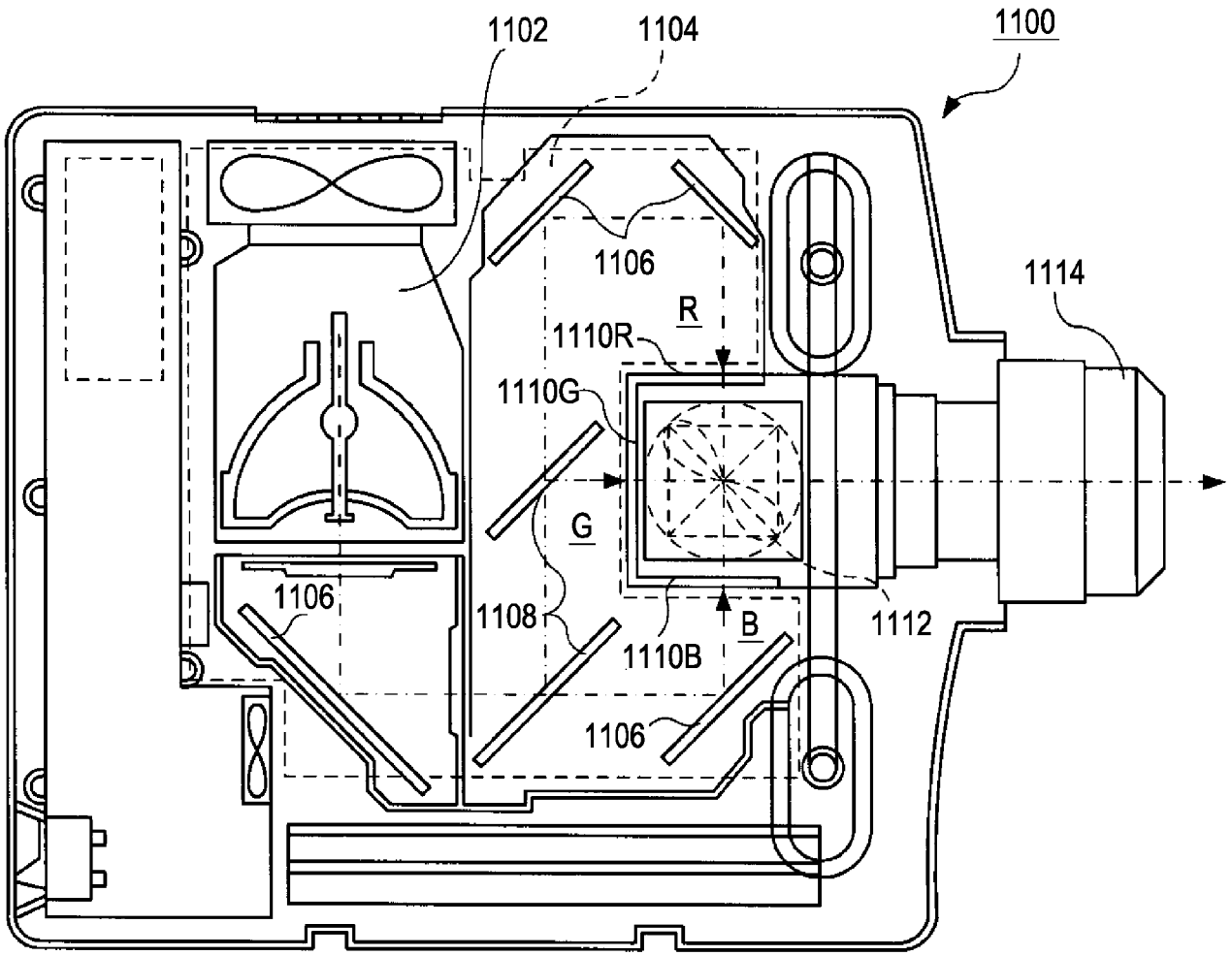
FIG. 10 is a plan view showing a configuration of a projector which is an example of an electronic apparatus which may use the electro-optical device of the first embodiment.

Next, cases in which a liquid crystal device, the above-described electronic-optical device, is applied to various kinds of electronic apparatuses will be described. FIG. 10 is a plan view showing an exemplified structure of a projector. Hereinafter, a projector in which the liquid crystal device is used as a light valve will be described.

As shown in FIG. 10, a lamp unit 1102 made up of white light sources, such as a halogen lamp, is provided inside the projector 1100. Transmitted light emitting from the lamp unit 1102 is split into three primary colors of RGB by four mirrors 1106 and two dichroic mirrors 1108 placed in a light guide 1104, and enters liquid crystal panels 1110R, 1110B, and 1110G serving as light valves corresponding primary colors.

The structure of each of the liquid crystal panels 1110R, 1110B, and 1110G is the same as the above-described liquid crystal device and is driven by any of primary color signals R, G, and B supplied from the image signal processing circuit. The light modulated by these liquid crystal panels enters a dichroic prism 1112 in three directions. In the dichroic prism 1112, the R and B light components are reflected at an angle of 90° C., but G light component progresses straight. Accordingly, all color components of the image are synthesized and therefore the color image, such as a screen, is projected via a projection lens 1114.

Focusing on an image displayed by the liquid crystal panels 1110R, 1110B, and 1110G, an image displayed by the liquid crystal panel 1110G must be reversed right and left with respect to the images displayed by the liquid crystal panels 1110R and 1110B.

Light corresponding to R, G, and B primary colors enters the liquid crystal panels 1110R, 1110B, and 1110G through a dichroic mirror 1108. Accordingly, there is no need for a color filter.

Besides the electronic apparatus with reference to FIG. 10, there the electro-optical device according to the invention also can also be applied to other devices, such as a mobile-type personal computer, a cellular phone, a liquid crystal television, a viewfinder-type or a monitor-type video tape reorder, a car navigation device, a pager, an electronic scheduler, a calculator, a word processor, a workstation, a television phone, a POS terminal, and apparatuses with a touch panel.

Besides the liquid crystal device described in the above-mentioned embodiments, the invention can be applied to a reflective liquid crystal device (LCOS), a plasma display (PDP), an electric field emission display (FED, SED), an organic electroluminescence display, a digital micro-mirror device (DMD), and an electrophoresis display.

The invention is not limited to the above-mentioned embodiments and can be modified as long as it does not conflict with the spirit of the invention construed from over the claims and specification. The electro-optical device accompanied with the modifications, a substrate for the electro-optical device, and the electronic apparatus including the electro-optical device will be within the technical scope of the invention.

What is claimed is:

1. An apparatus for driving an electro-optical device comprising:

a plurality of scanning lines;

a plurality of data lines that intersect the plurality of scanning lines;

the plurality of data lines including a plurality of groups of data lines;

each of the plurality of groups of data lines including a predetermined number of data lines of the plurality of data lines;

a plurality of pixels that are disposed at position corresponding to intersections between the plurality of scanning lines and the plurality of data lines;

a driving circuit that output a first image signal and a second image signal to at least one of the plurality of data lines; and a pre-charge circuit that output a first pre-charge signal and a second pre-charge signal to at least the one of the plurality of data lines, the first image signal which having a positive polarity with respect to a predetermined potential, the second image signal which having a negative polarity with respect to the predetermined potential, the first pre-charge signal having a first potential which has any one of the positive polarity and the negative polarity, the first pre-charge signal being outputted before the first image signal being supplied to at least the one of the plurality of data lines, and the second pre-charge signal having a second potential which has same polarity with the first pre-charge signal with respect to the predetermined potential, the second pre-charge signal being outputted before the second image signal being supplied to at least the one of the plurality of data lines, an amplitude of the first potential being lower than an amplitude of the second potential when the first and second potentials have the same polarity with the second image signal, the amplitude of the second potential being lower than the amplitude of the first potential when the first and second potentials have same polarity with the first image signal.

2. The apparatus according to claim 1, the first pre-charge signal being simultaneously supplied to the plurality of data lines.

3. The apparatus according to claim 1, the second pre-charge signal being simultaneously supplied to the plurality of data lines.

4. The apparatus according to claim 1, a first driving voltage being supplied to at least the one of the plurality of data lines as the first image signal, and a second driving voltage being supplied to at least the one of the plurality of data lines as the second image signal.

5. The apparatus according to claim 1, the first pre-charge signal and the second pre-charge signal having the negative polarity with respect to the predetermined potential.

6. The apparatus according to claim 1, driving voltages including the first driving voltage and the second driving voltage being supplied to the plurality of data lines, the first driving voltage having the highest voltage level among the driving voltages, the second driving voltage having the lowest voltage level among the driving voltages, and the first potential and the second potential having a level ranging from the lowest voltage level to the highest voltage level.

7. An apparatus for driving an electro-optical device comprising:

a scanning line;

a first data line and a second data line that intersect the scanning line;

a first pixel that are disposed at position corresponding to intersection between the scanning line and the first data line;

a second pixel that are disposed at position corresponding to intersection between the scanning line and the second data line;

a driving circuit that output a first image signal and a second image signal to the first data line and the second data line; and a pre-charge circuit that output a first pre-charge signal and a second pre-charge signal to the first data line and the second data line, the first image signal which having a positive polarity with respect to a predetermined potential, the second image signal which having a negative polarity with respect to the predetermined potential, the first pre-charge signal having a first potential which has any one of the positive polarity and the negative polarity, the first pre-charge signal being outputted before the first image signal being supplied to at least one of the first data line and the second data line, and the second pre-charge signal having a second potential which has same polarity with the first pre-charge signal with respect to the predetermined potential, the second pre-charge signal being outputted before the second image signal being supplied to at least the one of the first data lines and the second data line, an amplitude of the first potential being lower than an amplitude of the second potential when the first and second potentials have the same polarity with the second image signal, the amplitude of the second potential being lower that the amplitude of the first potential when the first and second potentials have same polarity with the first image signal.

8. The apparatus according to claim 7, none of transistors which being included in the first pixel and the second pixel are in on-states during a period in which the first pre-charge signal is supplied to the first data line and the second data line.

9. The apparatus according to claim 7, none of transistors which being included in the first pixel and the second pixel are in on-states during a period in which the second pre-charge signal is supplied to the first data line and the second data line.

10. A method for driving an electro-optical device that includes a plurality of scanning lines, a plurality of data lines that intersect the plurality of scanning lines, a plurality of pixels that are disposed at position corresponding to intersections between the plurality of scanning lines and the plurality of data lines, the method comprising:

supplying a first pre-charge signal has a first potential that has any one of a positive polarity and a negative polarity with respect to a predetermined potential to at least one of the plurality of data lines;

supplying a first image signal which has a positive polarity with respect to the predetermined potential to at least the one of the plurality of data lines;

supplying a second pre-charge signal has a second potential that has same polarity with the first pre-charge signal with respect to the predetermined potential to at least one the of the plurality of data lines, the second potential is different than the first potential; and supplying a second image signal which has a negative polarity with respect to the predetermined potential to at least the one of the plurality of data lines, an amplitude of the first potential being lower than an amplitude of the second potential when the first and second potentials have the same polarity with the second image signal, the amplitude of the second potential being lower than the amplitude of the first potential when the first and second potentials have same polarity with the first image signal.

11. The method according to claim 10, in a first horizontal period, the supplying of the first image signal being carried out before the supplying of the second image signal.

12. The method according to claim 10, in a second horizontal period, the supplying of the second image signal being carried out after the supplying of the first image signal.

* * * * *